US008869726B2

(12) United States Patent
Skiadas

(10) Patent No.: US 8,869,726 B2
(45) Date of Patent: Oct. 28, 2014

(54) SALVAGING DEVICE AND SALVAGING METHOD FOR SALVAGING CONDENSED MATTER LOCATED ON THE WATER SURFACE OF A WATERWAY

(71) Applicant: Atlas Elektronik GmbH, Bremen (DE)

(72) Inventor: Elias Skiadas, Ganderkesee (DE)

(73) Assignee: Atlas Elektronik GmbH (DE)

( * ) Notice: Subject to any disclaimer, the term of this patent is extended or adjusted under 35 U.S.C. 154(b) by 138 days.

(21) Appl. No.: 13/705,226

(22) Filed: Dec. 5, 2012

(65) Prior Publication Data

US 2013/0160692 A1 Jun. 27, 2013

(30) Foreign Application Priority Data

Dec. 27, 2011 (DE) ..... 10 2011 122 533

(51) Int. Cl.
*B63B 27/30* (2006.01)
*B63B 27/36* (2006.01)

(52) U.S. Cl.
CPC ..... *B63B 27/30* (2013.01); *B63B 27/36* (2013.01)
USPC ..... 114/259

(58) Field of Classification Search
USPC ..... 114/258, 259, 353, 373, 51; 414/137.4, 414/137.7; 210/242.1
See application file for complete search history.

(56) References Cited

U.S. PATENT DOCUMENTS

| | | | | |
|---|---|---|---|---|
| 3,268,081 | A | 8/1966 | Menkee et al. | |
| 3,951,810 | A | 4/1976 | Crisafulli | |
| 4,271,553 | A * | 6/1981 | Korsvik | 114/373 |
| 4,545,315 | A | 10/1985 | Becherer | |
| 4,959,143 | A | 9/1990 | Koster | |
| 6,840,188 | B1 | 1/2005 | Witbeck | |
| 7,028,627 | B2 | 4/2006 | Bouchaud et al. | |
| 2010/0018449 | A1 | 1/2010 | Luccioni et al. | |

FOREIGN PATENT DOCUMENTS

| | | | |
|---|---|---|---|
| DE | 2130207 | A | 12/1971 |
| DE | 19544656 | C1 | 2/1997 |
| DE | 6010279 | T2 | 9/2004 |
| DE | 202010015531 | U1 | 2/2011 |
| FR | 2249803 | A1 | 5/1975 |
| FR | 2686567 | A1 | 7/1993 |
| WO | 97/29012 | A1 | 8/1997 |
| WO | 03/087501 | A1 | 10/2003 |

OTHER PUBLICATIONS

International Search Report from corresponding DE 10 2011 122 533.5 filed Dec. 27, 2011.

* cited by examiner

*Primary Examiner* — Lars A Olson
(74) *Attorney, Agent, or Firm* — Polster Lieder

(57) ABSTRACT

The invention relates to a salvaging device and a salvaging method for salvaging condensed matter, such as an underwater vehicle, located on the water surface of a waterway. The salvaging device is an unmanned watercraft and comprises a boat hull with a maneuvering means and with a carrier device as well as a salvaging receptacle fastened to the boat hull. The watercraft is maneuvered in a self-driven manner on the water surface and collects the condensed material into the salvaging receptacle where the collected matter is stored. A crane of a supply ship then lifts the salvaging device and stored condensed matter out of the waterway. The invention permits the salvaging of the condensed matter, e.g., an underwater vehicle, with a reduced risk of damage to the condensed matter, as well as with a reduced risk to personnel who do not need to enter the water for this purpose.

12 Claims, 5 Drawing Sheets

SALVAGING DEVICE AND SALVAGING METHOD FOR SALVAGING CONDENSED MATTER LOCATED ON THE WATER SURFACE OF A WATERWAY

CROSS-REFERENCE TO RELATED APPLICATIONS

This application claims the benefit, under 35 U.S.C. §119, of DE 10 2011 122 533.5, filed Dec. 27, 2011, the disclosure of which is incorporated herein by reference in its entirety.

FIELD

The present teachings relate to a salvaging device and a salvaging method for salvaging condensed matter which is located on the water surface of a waterway, in particular for salvaging an unmanned underwater vehicle.

BACKGROUND

The statements in this section merely provide background information related to the present disclosure and can not constitute prior art.

Autonomous underwater vehicles (AUVs) and remotely operated underwater vehicles (ROVs) are generally released into the water by a supply ship before carrying out a mission and after the end of the mission the underwater vehicle is salvaged again by the supply ship.

Different versions are produced of such a known underwater vehicle configured as an AUV. A "combat version" is detonated during or after the mission and thus does not have to be salvaged. A so-called "inspection version" and a so-called "training version" are salvaged in different ways. The inspection version of the underwater vehicle is collected by means of a net, lifted out of the water by means of a crane and moved to the deck of the supply ship. To this end, the underwater vehicle has to be maneuvered into the immediate vicinity of the supply ship which involves the risk of a collision with the supply ship and thus the risk of damage to the underwater vehicle, in particular in the event of rough seas and/or high winds.

An apparatus for salvaging a device floating on the water surface, such as for example an underwater vehicle, is disclosed in DE 195 44 656 C1, by which the risk of damage to the underwater vehicle during the salvaging operation is reduced, even in the case of rough seas. There are, however, situations such as, for example, low battery voltage, malfunctions and/or an accident to the underwater vehicle in which the underwater vehicle is not able to be automatically recovered by means of a net or a line. Even the training version of the underwater vehicle is, in principle, not able to be directly recovered by means of a net or a line by the supply ship, as the training version is similar to the combat version of the underwater vehicle and, therefore, in the manner of the combat version of the underwater vehicle, for safety reasons has a protective mechanism which is not able to be switched off, which prevents the underwater vehicle from approaching the supply ship below a minimum distance.

In all of these cases in which the underwater vehicle is not able to be directly salvaged by the supply ship by means of a net or by means of a line, an inflatable boat with a crew is generally released into the water, the crew manually collects the underwater vehicle and brings the underwater vehicle together with the inflatable boat back on board the supply ship. The salvaging of the underwater vehicle by means of an inflatable boat is, however, in many respects a dangerous undertaking, in particular in rough seas, in high winds and/or in cold weather. For example, a collision of the underwater vehicle with the inflatable boat can lead to damage of the underwater vehicle, damage of the inflatable boat, capsizing of the inflatable boat and injury of the crew.

SUMMARY

The object of the invention, in view of the above, is to reduce risks when salvaging condensed matter located on the water surface of a waterway, in particular an unmanned underwater vehicle, and to facilitate the salvaging operation.

The term "condensed matter", as used herein, encompasses observed objects, which have a rest mass, in the form of a solid body, liquid or soft matter. The invention, however, relates in particular to the salvaging of an unmanned underwater vehicle which is preferably configured as an autonomous underwater vehicle (AUV), but alternatively can also be configured as a remotely operated underwater vehicle (ROV) operating by a cable connection.

The invention solves this object by providing an unmanned watercraft as a salvaging device which is partially interposed relative to the supply ship for salvaging the condensed matter and/or the underwater vehicle. The unmanned watercraft and/or the salvaging device collects the condensed matter and/or the underwater vehicle, whilst the salvaging device with the condensed matter and/or the underwater vehicle subsequently travels back to the supply ship and is collected by the supply ship and lifted out of the water.

The collection of the underwater vehicle by the salvaging device takes place without a crew on board the salvaging device, preventing a risk to personnel during the salvaging operation. Moreover, the underwater vehicle is protected from damage by the salvaging device when the salvaging device approaches the supply ship with the underwater vehicle and is lifted out of the water by the supply ship. Moreover, there is less risk of a collision of the salvaging device with the supply ship than a collision of the underwater vehicle with the supply ship, as the salvaging device together with the underwater vehicle is located in a more stable manner in the water due to its greater mass relative to the underwater vehicle. Finally, the salvaging device is also able to be collected more easily by the supply ship than the underwater vehicle. The underwater vehicle is optimized for its actual intended use and thus for movement below the water surface which is contrary to a design which is optimal in terms of being able to be salvaged itself. The salvaging device, however, does not have to be submersible and, therefore, is preferably an unmanned surface watercraft which is specifically designed to be salvaged by the supply ship.

In detail, the salvaging device has a boat hull and a salvaging receptacle fastened thereto. The boat hull in turn comprises a maneuvering means for maneuvering in a self-driven manner on the water surface of a waterway and a carrier device for lifting the watercraft out of the waterway by means of a crane. The salvaging receptacle is configured for collecting condensed matter located on the water surface into the salvaging receptacle even outside the range of the crane. Moreover, the salvaging receptacle is configured for storing the collected matter in the salvaging receptacle when maneuvered into the range of the crane. Finally, the salvaging receptacle is configured for lifting the stored condensed matter together with the watercraft out of the waterway.

According to the salvaging method of the invention, the watercraft is maneuvered in a correspondingly self-driven manner on the water surface of the waterway, the watercraft collects the condensed matter into the salvaging receptacle fastened to the boat hull, in particular outside the range of the crane for lifting the watercraft out of the waterway, and is maneuvered into the range of the crane and at the same time stores the collected condensed matter in the salvaging receptacle. The crane finally lifts the watercraft together with the condensed matter stored in the salvaging receptacle out of the waterway, by means of the carrier device.

The invention is not limited to the salvaging of an underwater vehicle. Instead, the condensed matter can be any solid body, for example, a watercraft, a living or dead person, a buoy, a mine or refuse. The salvaging receptacle is preferably a trough, a net, a cage or a refuse bag for collecting, storing and recovering the solid body. The trough is preferably water-permeable, so that only the solid body is stored and water is able to flow out, for example when the salvaging device is lifted with the solid body out of the water. Moreover, the trough can be configured to be rigid or even flexible.

Alternatively, the condensed matter can be a liquid, e.g., a chemical or oil. Accordingly, the salvaging receptacle can be a receptacle or a trough for collecting, storing and recovering the liquid. The receptacle and/or the trough is, once again, configured to be rigid or flexible.

Thus, the invention can be used, for example, for rescuing people overboard and floating in the water, for salvaging floating bodies, for removing refuse, for recovering buoys or for cleaning the waterway of environmental pollutants floating on the water surface, such as for example discharged oil. The salvaging receptacle is selected and/or optimized for the respective purpose and/or the type of condensed matter to be salvaged.

In various embodiments of the invention, different variants of the salvaging receptacle are provided which can be used in an interchangeable manner for salvaging different types of condensed matter. The salvaging device can, therefore, be equipped in turn with the different variants of the salvaging receptacle and used in many different ways.

Preferably, the salvaging receptacle is able to adopt a plurality of positions, namely at least one collecting position with an opening for collecting the condensed matter as well as a storage position which can be alternatively adopted, in which the opening for the collected condensed matter is closed, for storing the collected condensed matter. By changing the positions of the salvaging receptacle, therefore, the condensed matter and/or the underwater vehicle can be stored securely in the salvaging receptacle after being collected.

In various embodiments, the salvaging device has a mounting for the salvaging receptacle that is pivotable relative to the boat hull of the salvaging device, for changing from the collecting position to the storage position of the salvaging receptacle. If the watercraft floats on the surface of the waterway, the mounting is pivotable from a position below the water surface to a position above the water surface and preferably also vice versa. According to the method, the mounting pivots from the position below the water surface to the position above the water surface, so that the condensed matter is able to move by floating in the water through the opening into the salvaging receptacle, but after the pivoting of the mounting above the water surface is collected in the salvaging receptacle and/or secured against floating out.

In various embodiments, the boat hull comprises at least one floating body for providing static buoyancy. As a result, the salvaging device is passively, in particular permanently, held as a surface watercraft on the water surface. Even when the salvaging device is incapable of being maneuvered in the event of a defect, it therefore continues to float on the surface of the waterway.

In various embodiments, the boat hull comprises at least two of the floating bodies which are aligned, in particular, parallel to one another and are able to collect the condensed matter in the middle thereof. Moreover, the salvaging device preferably has at least one pair of pivoting arms which are pivotable relative to one another in order to fold up the boat hull. The pivoting arms are connected in each case with one end to the carrier device and with the other end thereof to one respective floating body. As a result, it is possible to stow the salvaging device in a space-saving manner on board the supply ship, whilst the salvaging device is able to adopt a stable position on the water with the pivoting arms spread apart.

In advantageous embodiments, the salvaging device has a damping means for damping the striking of the stored condensed matter and/or the salvaging receptacle with the stored condensed matter against the boat hull. The damping means are preferably arranged on the boat hull, particularly on the floating body and/or on the floating bodies. The condensed matter stored in the salvaging device and/or the underwater vehicle, therefore, does not strike directly against the boat hull and/or against the floating body or floating bodies but against the damping means so that damage to the condensed matter and/or the underwater vehicle is prevented when transported with the salvaging device.

In various embodiments, the salvaging device has a visual observation device for providing image data in order to monitor the collection of the condensed matter by means of the image data. The visual observation device comprises, for example, a camera.

In various embodiments, the salvaging device has an illuminating device for illuminating the condensed matter when monitoring the collecting operation. In this manner, the salvaging operation is assisted during the hours of darkness.

In various embodiments, the salvaging device has a control device for controlling the maneuvering means according to control signals provided. In this manner, the salvaging device is able to be remotely controlled.

In various embodiments, the salvaging device also has a radio communication device for receiving the control signals via radio and supplying the control signals for the control device. The salvaging operation can, therefore, be remotely controlled via radio.

According to various embodiments of the invention, the radio communication device is also configured for transmitting confirmation signals. As a result, a bidirectional communication and/or a data exchange is possible via the radio communication device between the salvaging device and, for example, a supply ship.

Alternatively or additionally, the radio communication device is provided for transmitting via radio the image data supplied by means of the visual observation device. In this manner, the salvaging operation can be visually monitored re-motely.

Further embodiments are revealed from the claims and from the exemplary embodiments described in more detail with reference to the drawings.

Additionally, further areas of applicability of the present teachings will become apparent from the description provided herein. It should be understood that the description and specific examples are intended for purposes of illustration only and are not intended to limit the scope of the present teachings.

DRAWINGS

The drawings described herein are for illustration purposes only and are not intended to limit the scope of the present teachings in any way.

Corresponding reference numerals indicate corresponding parts throughout the several views of drawings.

DETAILED DESCRIPTION

Figure 1:
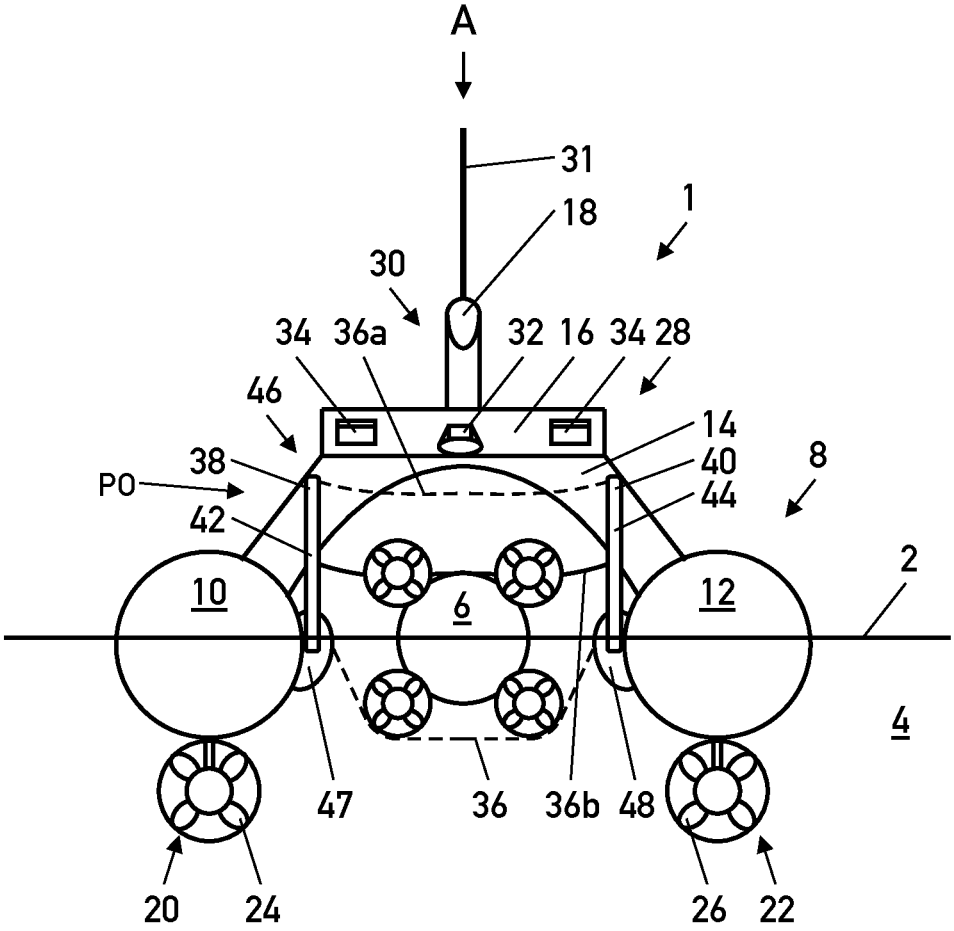
FIG. 1 shows a salvaging device configured as an unmanned watercraft according to various exemplary embodiments of the present disclosure in a view from the front.

The following description is merely exemplary in nature and is in no way intended to limit the present teachings, application, or uses. Throughout this specification, like reference numerals will be used to refer to like elements.

Figure 2:
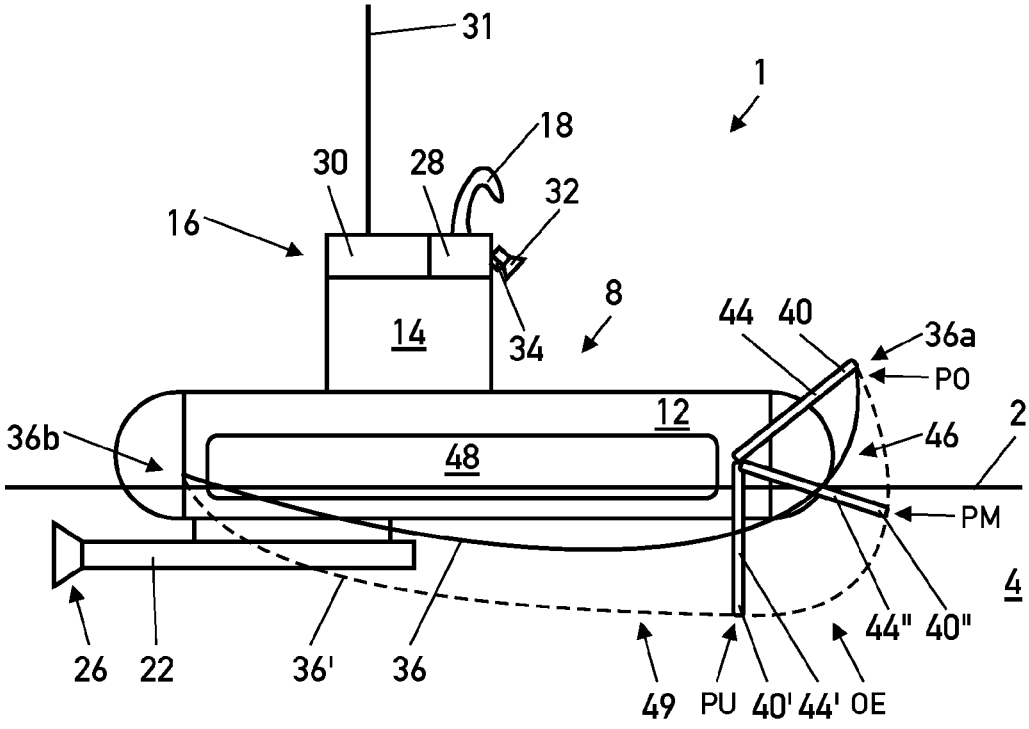
FIG. 2 shows the salvaging device/unmanned watercraft of FIG. 1 in a sectional view from the side according to section A in FIG. 1, in accordance with various embodiments of the present disclosure.

FIGS. 1 and 2 show an unmanned watercraft 1 as a salvaging device 1 according to various embodiments of the present disclosure. FIG. 1 shows the salvaging device 1 in a front view, floating on the water surface 2 of a waterway 4, together with a collected underwater vehicle 6 as an example of condensed matter to be salvaged.

The salvaging device 1 is configured as a surface watercraft and has a boat hull 8 with two floating bodies 10 and 12 which ensure buoyancy in the water and/or in the waterway 4, which keeps the salvaging device 1 floating on the water surface 2 of the waterway 4. The floating bodies 10 and 12 are spaced apart from one another, arranged parallel to one another and connected together by means of a framework 14 above the water surface 2, so that the salvaging device 1 is configured in the manner of a catamaran and is located in the water 2 in a stable manner. A compact boat structure 16 is arranged at the top on the framework 14. Moreover, the salvaging device 1 has a carrier device 18 arranged substantially centrally above the center of gravity of the salvaging device 1, and configured as a hook. The carrier device 18 is connected directly or indirectly, for example via the boat structure 16, to the framework 14 and protrudes above the framework 14 and the boat structure 16, so that the salvaging device 1 is able to be lifted out of the waterway 4, for example by means of a cable which can be hooked onto the carrier device 18, by a crane arranged on a supply ship, with a substantially horizontal alignment of the watercraft 1. The hook and/or the carrier device 18 are configured such that even in rough seas the salvaging device 1 is able to be collected and salvaged in a simple manner as it is maneuvered, for example, in the direction of a cable held substantially horizontally above the water surface 2, at least locally substantially transversely to the direction, so that the carrier device 18 is hooked onto the cable and the aforementioned crane is able to lift the salvaging device out of the water by means of the cable.

For maneuvering on the water surface 2, the boat hull 8 has two maneuvering means 20 and 22 arranged in each case below one of the floating bodies 10 and 12 and configured as drive gondolas. The maneuvering means 20 and 22 have energy storage devices in the interior thereof, not shown in the drawings, and motors supplied with electrical energy by the energy storage devices, which drive screw propellers and/or propellers 24 and 26.

According to an alternative exemplary embodiment, the maneuvering means 20 and 22 are not configured as drive gondolas but integrated in the floating bodies 10 and 12. Moreover, the maneuvering means 20 and 22 can alternatively be arranged such that the front end and rear end of the salvaging device 1 are interchanged relative to the view in FIG. 1, the terms being accordingly interchanged where mentioned below in the description.

The maneuvering means 20 and 22 are controlled by an electronic control unit and/or control device 28 arranged in the boat structure 16. A radio communication device 30 also arranged on the boat structure 16 receives by means of an antenna 31 the control signals via radio, preferably from the aforementioned supply ship, and supplies them to the control device 28. Conversely, the radio communication device 30 returns confirmation signals to the supply ship, the signals indicating successful reception of the control signals.

An observation device 32 configured as a camera and/or comprising a camera and two floodlights and/or illuminating devices 34 comprising two floodlights, merely by way of example, are arranged on the boat structure 16. The camera 32 and the floodlights 34 are aligned towards the front end of the salvaging device 1 and obliquely to the water surface 2, so that the collection of the underwater vehicle 6 can be monitored by means of the observation device 32. The observation direction of the camera 32 is either fixedly predetermined or adjustable, in particular pivotable. The pivoting of the observation direction takes place, for ex-ample, by motorized pivoting of the camera 32.

The underwater vehicle 6 located on the water surface 2, which also already protrudes partially from the water surface 2 before the collecting operation, can thus be visually detected by means of the observation device 32, the underwater vehicle 6 being able to be additionally illuminated by means of the illuminating device 34, in particular in darkness. The observation device 32 is connected to the radio communication device 30 such that image data can be transmitted from the observation device 32 to the radio communication device 30 and from the radio communication device 30 by means of the antenna 31 to the supply ship. The collection can be visually monitored, therefore, and automatically or manually controlled depending on the image data.

Alternatively or additionally, the salvaging device 1 comprises a radar reflector and/or a responder, radar signals and/or radio signals being able to be taken into account, in particular as distance measurements, for example via propagation times, during the collecting operation and/or when controlling the collection of the condensed matter 6.

In the view shown in FIG. 1, the underwater vehicle 6 is collected and stored in a salvaging receptacle 36 of the salvaging device 1, fastened to the boat hull 8 and configured as a net. In particular, the net 36 is fastened at the rear end of the salvaging device 1 to the boat hull 8 and/or to the floating bodies 10 and 12. The net 36 is fastened at the front end of the salvaging device 1 to a mounting and/or mountings 38 and 40. The edge of the net 36 is denoted at the front end of the salvaging device 1 by the reference numeral 36*a* and at the rear end of the salvaging device 1 by the reference numeral 36*b*.

The mountings 38 and 40 are arranged on mounting rods 42 and 44 and, in the storage position 46 shown in FIG. 1 of the net 36, arranged in a position PO above the water surface 2. The edge 36*a* of the net 36 at the front end of the salvaging device 1 is arranged in the storage position 46, thus also above the water surface 2. The underwater vehicle 6 in this storage position 46 is stored securely in the net 36 and thus can be transported by means of the salvaging device 1 to the supply ship and lifted together with the salvaging device 1 out of the waterway 4. Damping means 47 and 48 are arranged on the floating bodies 10 and 12 for dampening the potential striking of the underwater vehicle 6 against the floating bodies 10 and 12, in particular in rough seas and reduce the risk of damage to the underwater vehicle 6. To this end, the damping means 47 and 48 preferably comprise a reversibly deformable material. Alternatively or additionally, damping means 47 and 48 can also be arranged on the framework 14.

FIG. 2 shows the salvaging device and/or the unmanned watercraft 1 of the exemplary embodiments of FIG. 1 in a sectional view from the side according to the section A indicated in FIG. 1. In FIG. 2, the rear end of the salvaging device 1 is arranged to the left and the front end to the right. The same reference numerals denote the same components.

In contrast to the view according to FIG. 1, the salvaging device in FIG. 2 is shown without the underwater vehicle 6. Moreover, the salvaging receptacle and/or net 36 is not only shown in the storage position 46 but additionally in a collecting position 49 in dashed lines as the salvaging receptacle and/or net 36'. The reference numerals 36 and 36' denote, therefore, the same net 36, 36' in the storage position 46 and/or in the collecting position 49, but only one of the positions 46, 49 being able to be adopted by the net 36, 36' at any point in time.

In the collecting position 49, the mounting 40 is arranged as a mounting 40' in a position PU below the water surface 2 when the salvaging device 1 is located in the waterway 4. It should be understood that the mounting 38, not shown in FIG. 2 is simultaneously arranged in a position PU below the water surface 2 when the salvaging device 1 is located in the waterway 4. As a result, it is possible for the salvaging device 1 to be moved with the floating bodies 10 and 12 along both sides laterally adjacent to the underwater vehicle 6, and at the same time pull the net 36' below the underwater vehicle 6. The required relative movement of the salvaging device 1, in relation to the underwater vehicle 6, is effected in this case by the maneuvering means 20 and 22, but alternatively or additionally also by drives of the underwater vehicle 6.

In the exemplary embodiments shown in FIG. 2, the exchange between the storage position 46 and the collecting position 49 takes place by the mounting 40 (and mounting 38 not shown) being pivoted relative to the boat hull 8 via a central position PM, in which the mounting 40, 40' is denoted by the reference numeral 40", from the position PO to the position PU. The pivoting from the storage position 46 into the collecting position 49 takes place by the mounting rod 44 and/or similarly the mounting rod 42 being pivoted about a rotational axis arranged horizontally in the region of the floating body 12, until the mounting 40' reaches the position PU, in which the mounting rod 44 is denoted by the reference numeral 44', via the position PM, in which the mounting rod 44 is denoted by 44". Naturally, alternative embodiments of the invention are also possible which provide an opening OE for the underwater vehicle 6 in the net 36 in the region of the water surface 2, when the net 36 is located in the collecting position 49, the opening OE being closed in the storage position 46.

Figure 3:
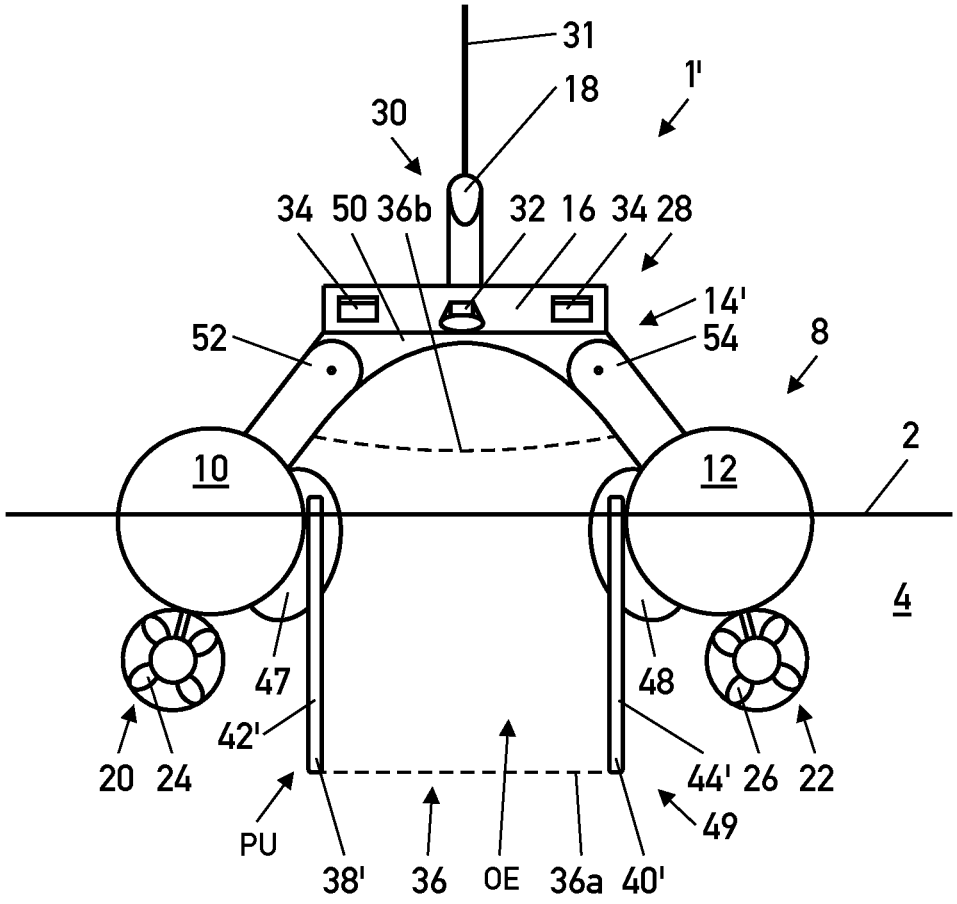
FIG. 3 shows the salvaging device configured as an unmanned watercraft according to other exemplary embodiments of the present disclosure in a view from the front.

FIG. 3 shows a salvaging device 1' configured as an unmanned watercraft which floats on the water surface 2 of the waterway 4 in the manner of the salvaging device 1 as described above with regard to FIGS. 1 and 2, according to various other exemplary embodiments of the invention in a view from the front. The salvaging device 1' is largely similar to the salvaging device 1. In particular, the same reference numerals denote the same or at least similar components and/or positions. The essential difference of the salvaging device 1' relative to the salvaging device 1 is a pivotability of the floating bodies 10 and 12 relative to one another. The pivotability is achieved by a framework 14' which has a central framework portion 50 and two pivoting arms 52 and 54 which are pivotable relative to the central framework portion 50 and thus relative to one another. In the view according to FIG. 3, the pivoting arms 52 and 54 are spread apart, so that an arrangement of the pivoting bodies 10 and 12 relative to one another is produced which is similar to the arrangement of the pivoting bodies 10 and 12 in the salvaging device 1 according to FIG. 1. In this arrangement, the pivot axes for the mounting rods 42 and 44, which are shown here in the collecting position 49 as the mounting rods 42' and 44', are pivotable about horizontally arranged pivot axes extending in the transverse direction of the salvaging device 1'. This accordingly results in the pivotability of the mounting 40' and/or a mounting 38', which denotes the mounting 38 in the collecting position 48.

The pivoting rods 42 and 44 and/or 42' and 44' are preferably pivotable by electric motor, a drive device such as an electric motor, for example a servo motor with a gear unit, being arranged on the floating bodies 10 and 12 or one of the floating bodies 10 or 12.

The pivoting arms 52 and 54 can also be pivotable in a motorized manner. Alternatively, however, a pivotability can also be provided which is manual and/or produced mechanically without a motor. Preferably, the pivoting arms 52 and 54 are able to be latched in the arrangement shown in FIG. 3 to the central framework portion 50, such that they remain in the folded up and/or spread apart position and do not automatically pivot relative to one another until they are actively released from this position.

The maneuvering means 20 and 22 are not arranged centrally below the floating bodies 10 and 12 relative to the arrangement in the salvaging device 1 according to FIG. 1, but in contrast are arranged offset relative to the outer faces of the salvaging device 1'. As a result, a substantial pivoting of the pivoting arms 52 and 54 towards one another and thus a space-saving accommodation of the salvaging device 1' is possible, without the maneuvering means 20 and 22 opposing such an arrangement or colliding with one another when pivoted and thus being able to be damaged.

In a deviation from the exemplary embodiments shown, however, the maneuvering means 20 and 22 can also be configured to be removable from the floating bodies 10 and 12. In this case, an arrangement of the maneuvering means 20 and 22 centrally below the floating bodies 10 and/or 12 according to the exemplary embodiments of FIG. 1 is advantageous even in the case of a pivotability of the floating bodies 10 and 12 relative to one another. Before folding up the salvaging device 1' by pivoting the floating bodies 10 and 12 towards one another, in this case the maneuvering means and/or drive gondolas 20 and 22 are dismantled. Alternatively, the maneuvering means 20 and 22 can in turn be integrated in the floating bodies 10 and 12.

Figure 4:
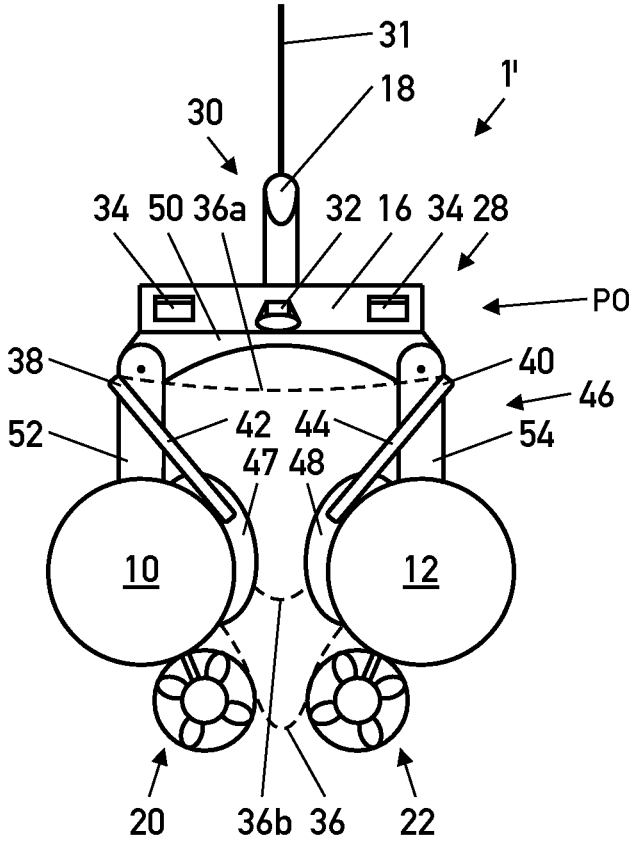
FIG. 4 shows the salvaging device/unmanned watercraft of shown in FIG. 3 with pivoting arms folded up in a view from the rear, in accordance with various embodiments of the present disclosure.

FIG. 4 shows the salvaging device and/or the unmanned watercraft 1' of the exemplary embodiments according to FIG. 3 with the pivoting arms 52 and 54 and/or the floating bodies 10 and 12 in a position in which the salvaging device 1' can be accommodated in a space-saving manner on board the supply ship. The floating bodies 10 and 12 are in this case also arranged parallel to one another. However, relative to the arrangement according to FIG. 3 the distance between the floating bodies 10 and 12 is reduced by the floating bodies 10 and 12 being pivoted towards one another by means of the pivoting arms 52 and 54 and/or the salvaging device 1' being folded up. The damping means 47 and 48 once again fulfill a protective function here. If the floating bodies 10 and 12 were to strike against one another, the damping means would dampen an impact and thus also protect the maneuvering means 20 and 22 from damage, which could otherwise occur if the floating bodies 10 and 12 were to strike against one another without damping.

In various embodiments, the pivoting arms 52 and 54 can also be blocked in the space-saving arrangement shown in FIG. 4, so that they are only able to be spread apart again after releasing the blocking. In various embodiments, the salvaging device 1' is configured such that the blocking which holds the salvaging device 1' in the arrangement shown in FIG. 4 is automatically released in response to a corresponding control signal which the radio communication device 30 receives. Furthermore, the salvaging device 1' can be configured such that the carrier device 18 can be pulled out relative to the central framework portion 50 in the vertical direction and connected to a mechanism which, if the salvaging device 1' is suspended on the carrier device 18, causes the pivoting arms 52 and 54 and/or the floating bodies 10 and 12 to be spread apart mechanically by their own weight, when the blocking is released. In this manner, it is possible to change the position of the salvaging device 1' in a compact arrangement on board the supply ship by means of a crane, and to lift the salvaging device 1' above the water. Before the salvaging device 1' is released into the water, the blocking can be released via radio, whereupon the pivoting arms 52 and 54 are automatically spread apart by the inherent weight of the salvaging device 1' and preferably latched in the spread-apart position, so that the salvaging device 1' is subsequently located in a stable manner in the water.

Figure 5:
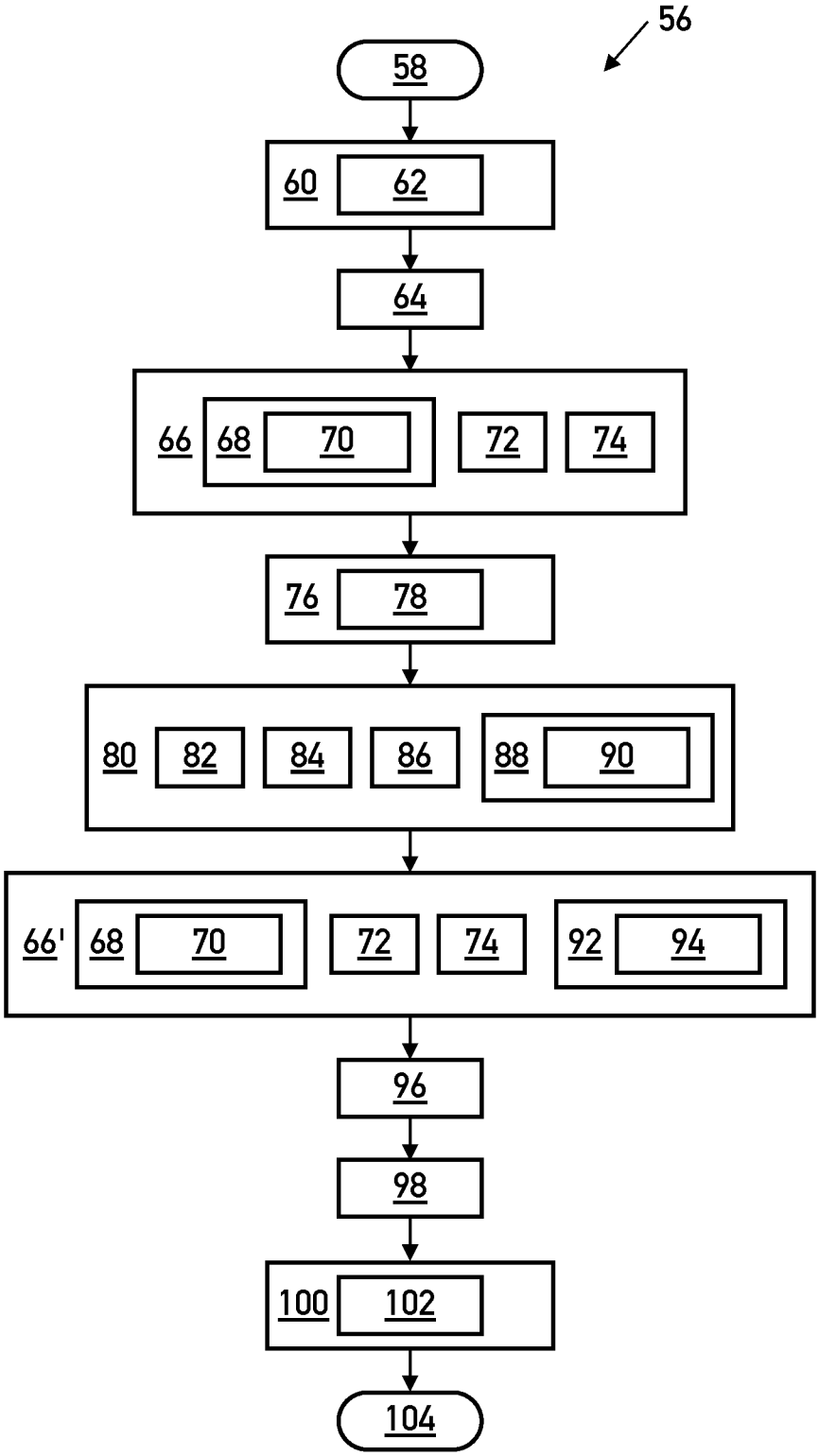
FIG. 5 shows a block diagram for illustrating a salvaging method according to various embodiments of the present disclosure.

FIG. 5 shows a block diagram for illustrating a salvaging method 56 according to various exemplary embodiments of the invention. After starting in a step 58, the folding out of the salvaging device 1' from the arrangement in FIG. 4 to that in FIG. 3 follows in a step 60. This takes place by means of a pivoting of the pivoting arms 52 and 54, in a step 62. Subsequently, in a step 64, the salvaging device 1 is released into the water and/or is deposited on the water surface 2 by means of a crane via a cable on which the salvaging device 1' is suspended. The hook and/or the carrier device 18 are released from the cable. Subsequently, in a step 66, the salvaging device 1' is maneuvered away from the supply ship by means of the crane towards the unmanned, in particular autonomous, underwater vehicle 6 which is to be salvaged and/or towards the condensed matter which is to be salvaged.

The step 66 contains a plurality of steps. In particular, the salvaging device 1' when maneuvered 66 is held on the water surface 2 of the waterway 4 according to a step 68. This is achieved by a step 70, according to which the floating bodies 10 and 12 provide a static buoyancy for the salvaging device 1'. Furthermore, the maneuvering 66 involves the radio communication device 30 according to a step 72 receiving control signals via radio and forwarding the signals to the control device 28 and according to a step 74, the control device 28 returning confirmation signals in response to the received control signals and accordingly controlling the salvaging device 1' by suitable activation of the maneuvering means 20 and 22.

If the salvaging device 1' has come within the vicinity of the underwater vehicle 6, the salvaging receptacle 36 changes from the storage position 46 into the collecting position 49 and/or the salvaging receptacle 36 and/or net adopts the collecting position 49 according to a step 76. This step 76 involves a step 78, according to which the mountings 38 and 40 for the net 36 on the front end and/or rear end of the salvaging device 1 and/or the edge 36*a* of the net 36 pivots below the water surface 2, and thus the opening OE is opened and/or cleared.

The collection of the underwater vehicle 6 and/or the condensed matter to be collected follows according to a step 80. In this case, in a step 82 a region in front of the salvaging device 1' and/or the underwater vehicle 6 located in front of the salvaging device 1' is illuminated by means of the illuminating device 34 according to a step 82. By means of the observation device 32, in a step 84, image data are produced and supplied to the radio communication device 30. The image data are transmitted according to a step 86 by means of the radio communication device 30, so that the data can be received on board the supply ship, and the collection 80 can thus be monitored remotely.

For the collecting operation, the salvaging device 1' and the underwater vehicle 6 move towards one another head-on, so that the underwater vehicle 6 moves through the opening OE, the floating bodies 10 and 12 move on both sides of the underwater vehicle 6 past portions of the underwater vehicle 6 and the framework 14' is pushed over portions of the underwater vehicle 6, and the net 36 is pushed below the underwater vehicle 6 and/or the underwater vehicle 6 is pushed through the opening OE. In this case, preferably no contact remains between the salvaging device 1' and the underwater vehicle 6. A possible side impact is damped by the damping means 47 and 48.

For the collecting operation, either the salvaging device 1' or the underwater vehicle 6 is driven or the salvaging device 1' and the underwater vehicle 6 are driven. In this case, the salvaging device 1' is able to move forwards and/or with the front end thereof at the front, and then rearwards and/or with the rear end thereof at the front and/or transport the collected underwater vehicle 6 in the opposing direction or, with a reversed allocation of the front end and rear end, for the collecting operation, move rearwards and/or with the rear end thereof at the front, and then forwards and/or transport the collected underwater vehicle 6 in the opposing direction. The initial movement in the vicinity of the underwater vehicle 6 to be salvaged is able to take place forwards or rearwards. Preferably, however, the direction of travel is only reversed for direct collection, so that the salvaging device 1' has a preferred direction of travel which it adopts before and after the collecting operation. The underwater vehicle 6 is thus transported in the designated direction of travel of the underwater vehicle 6. A cable which is optionally present and which pulls the underwater vehicle 6 behind, thus emerges from the salvaging device 1' in the region of the mounting rods 42 and 44 when the underwater vehicle 6 is collected, so that during the subsequent transportation the cable is also pulled behind the salvaging device 1'. As a result, the cable is held away from the screw propellers 24 and 26.

The collecting operation 80 is completed by a step 88 according to which the salvaging device 1' transfers the salvaging receptacle and/or net 36' from the collecting position 49 into the storage position 46, and/or in which the salvaging receptacle 36 adopts the storage position 46. The adoption of the storage position 88 is in turn achieved by a pivoting of the mounting 38, 40 according to a step 90 from the previously adopted position PU below the water surface 2 to the position PO above the water surface 2 and/or by a pivoting of the edge 36*a* of the net 36 level with a position below the water surface 2 to a position above the water surface 2 for closing the opening OE.

After collecting the underwater vehicle 6, a maneuvering of the salvaging device 1' according to a step 66' follows in turn, which is largely similar to the step 66 and in particular also comprises the steps 68, 70, 72 and 74. However, the salvaging device 1' now transports the underwater vehicle 6 and/or the collected condensed matter and, thus additionally comprises a step 92, according to which the underwater vehicle 6 and/or the collected condensed matter is stored in the salvaging receptacle 36' of the salvaging device 1'. In this case, according to a step 94, movements of the underwater vehicle 6 against the boat hull 8, in particular against the floating bodies 10 and 12, are damped by means of the damping means 47 and 48. In this manner, the salvaging device 1' is maneuvered back to the supply ship.

If the salvaging device 1' has come within the vicinity of the supply ship, the salvaging device 1' is collected by means of a cable, the hook and/or the carrier device 18 being hooked onto the cable. The salvaging device 1' is subsequently lifted on the cable out of the water by means of the crane according to a step 96 together with the underwater vehicle 6 stored in the salvaging device 1'. On board the supply ship, according to a step 98, the salvaged underwater object and/or the salvaged condensed matter 6 is removed from the salvaging device 1', optionally the net 36 being temporarily removed from the boat hull 8 and/or the net 36 being moved into the collecting position 49.

By way of example, the salvaging device 1' is lifted on board the supply ship such that the underwater vehicle 6 finally comes to bear against a carrier device provided therefor, the boat hull 8 being subsequently released and/or the net 36' being released from the boat hull 8 and from the mountings 38 and 40 and subsequently the boat hull 8 and/or the salvaging device 1' without the net 36' and without the underwater vehicle 6 being lifted by means of the crane and pivoted to a suitable storage point. The underwater vehicle 6 then bears in a freely accessible manner against the net 36' and thus can be lifted by means of the crane and moved to a designated storage point.

The salvaging device 1' is folded up again after the removal 98 of the underwater vehicle 6 and before it is stored, according to a step 100. This is achieved according to a step 102 by pivoting the pivoting arms 52 and/or 54 and/or by pivoting the floating bodies 10 and 12 towards one another. Thus, the method is completed according to a step 104.

Overall, the invention permits by simple means the salvaging of an underwater vehicle which is, in particular, autonomous, as well as other condensed matter, in particular with salvaging receptacles correspondingly adapted thereto, even in the event of bad weather with a reduced risk of damage to equipment or of personal injury relative to the prior art. The invention thus provides a valuable contribution to safety when salvaging underwater vehicles, people overboard, dead bodies, refuse or dangerous substances which float on the surface of a waterway.

All the features set forth in the above description and in the claims are able to be used both individually and in any combination with one another. The disclosure of the invention is thus not limited to the disclosed and/or claimed combination of features. Instead, all combinations of features can be considered as disclosed. That is, the description herein is merely exemplary in nature and, thus, variations that do not depart from the gist of that which is described are intended to be within the scope of the teachings. Such variations are not to be regarded as a departure from the spirit and scope of the teachings.

What is claimed is:

1. A salvaging device for salvaging condensed matter located on the water surface of a waterway, said salvaging device comprising:

an unmanned watercraft comprising a boat hull with a maneuvering means for maneuvering in a self-driven manner on the water surface and a carrier device for lifting the watercraft out of the waterway by means of a crane; and a salvaging receptacle fastened to the boat hull for collecting condensed matter located on the water surface into the salvaging receptacle outside the range of the crane, for storing the collected matter in the salvaging receptacle when maneuvered into the range of the crane and for lifting the stored matter together with the watercraft out of the waterway, wherein the salvaging receptacle is structured and operable to be disposed in a collecting position which can be adopted with an opening for collecting the condensed matter through the opening, and in a storage position which can be alternatively adopted, in which the opening for the collected condensed matter is closed, for storing the collected condensed matter.

2. The salvaging device according to claim 1, further comprising a mounting for the salvaging receptacle which is pivotable relative to the boat hull from a first position to a second position for changing from the collecting position to the storage position of the salvaging receptacle.

3. The salvaging device according to claim 2, wherein the boat hull comprises at least one floating body for providing a static buoyancy, holding the watercraft on the water surface when maneuvered.

4. The salvaging device according to claim 3, wherein the boat hull comprises at least two of the floating bodies and at least one pair of pivoting arms which are pivotable relative to one another for folding apart and folding up the boat hull, which are connected in each case with one end thereof to the carrier device and with the other end thereof to one respective floating body.

5. The salvaging device according to claim 4, further comprising a damping means for damping the striking of at least one of the stored condensed matter and the salvaging receptacle with the stored condensed matter against the boat hull.

6. The salvaging device according to claim 5, further comprising:

a visual observation device for providing image data in order to monitor the collection of the condensed matter by means of the image data;

an illuminating device for illuminating the condensed matter when monitoring the collecting operation;

a control device for controlling the maneuvering means according to control signals provided; and a radio communication device for receiving the control signals via radio and supplying the control signals for the control device, for returning confirmation signals and for transmitting via radio the image data supplied by means of the visual observation device.

7. A method for salvaging condensed matter located on the water surface of a waterway utilizing a salvaging device configured as an unmanned watercraft having a boat hull comprises a maneuvering means and a carrier device, said method comprising:

maneuvering the salvaging device in a self-driven manner on the water surface, collecting the condensed matter into a salvaging receptacle fastened to the boat hull, outside the range of a crane for lifting the watercraft out of the waterway, wherein collecting the condensed matter comprises:

configuring the salvaging receptacle to adopt a collecting position in which the salvaging receptacle comprises an opening;

collecting the condensed matter through the opening; and subsequently configuring the salvaging receptacle to adopt a storage position in which the opening for the collected condensed matter is closed and the collected condensed matter is stored in the salvaging receptacle;

maneuvering the salvaging device into the range of the crane and at the same time storing the collected matter in the salvaging receptacle; and lifting, via the crane, the watercraft together with the matter stored in the salvaging receptacle out of the waterway by means of the carrier device.

8. The method according to claim 7, wherein the salvaging receptacle changes from the collecting position to the storage position by a pivotable mounting for the salvaging receptacle pivoting relative to the boat hull from a position below the water surface to a position above the water surface.

9. The method according to claim 8 further comprising providing a static buoyancy which holds the watercraft when maneuvered on the water surface utilizing at least one floating body of the boat hull.

10. The method according to claim 9 further comprising:

folding out the boat hull by pivoting in a first direction, relative to one another, at least one pair of pivoting arms of the boat hull that are connected at one end thereof to the carrier device and connected at opposing ends to one respective floating body; and folding up the boat hull by pivoting in a second direction opposing the first direction, relative to one another, the at least one pair of pivoting arms of the boat hull.

11. The method according to claim 10 further comprising:

damping the striking of at least one of the stored condensed matter and the salvaging receptacle against the boat hull utilizing at least one damping means arranged on the at least one floating body.

12. The method according to claim 11, wherein collecting the condensed matter into a salvaging receptacle comprises:

providing image data in order to monitor the collection of the condensed matter by means of the image data utilizing a visual observation device of the watercraft;

illuminating the condensed matter when monitoring the collecting operation utilizing an illuminating device of the watercraft;

controlling the maneuvering means according to control signals provided utilizing a control device of the watercraft; and receiving the control signals, via radio communication, via a radio communication device of the salvaging device; and supplying the control signals to the control device that returns confirmation signals and transmits, via radio communications, the image data supplied by the visual observation device.

* * * * *